United States Patent [19]

Suzuki

[11] Patent Number: 4,900,973

[45] Date of Patent: Feb. 13, 1990

[54] ELECTRON TUBE SEALING STRUCTURE

[75] Inventor: Wakou Suzuki, Tokyo, Japan

[73] Assignee: NEC Corporation, Japan

[21] Appl. No.: 271,906

[22] Filed: Nov. 16, 1988

[30] Foreign Application Priority Data

Nov. 17, 1987 [JP] Japan ..... 62-291129

[51] Int. Cl.[4] ..... H01J 1/90; H01J 19/44

[52] U.S. Cl. ..... 313/251; 313/106; 313/107; 313/256; 313/260; 313/261; 313/446; 313/456

[58] Field of Search ..... 313/251, 256, 260, 261, 313/106, 107, 390, 446, 436, 334, 338, 353, 356, 313

[56] References Cited

U.S. PATENT DOCUMENTS 2,859,372 11/1958 Stangl ..... 313/256

3,227,905 1/1966 Talcott ..... 313/256

*Primary Examiner*—Donald J. Yusko

*Assistant Examiner*—Michael Horabik

*Attorney, Agent, or Firm*—Leydig, Voit & Mayer

[57] ABSTRACT

In an electron tube sealing structure, a cylindrical insulator is metallized to produce metallized layers on both end surfaces, and sealing metal members are soldered to the metallized layers correspondingly, so that a vacuum chamber is provided in the interior of the cylindrical insulator. The cylindrical insulator is provided with at least one salient portion at an inner end thereof. The salient portion is parallel to a direction of an electric field produced by a voltage applied across the sealing metal members, and shields one of the metallized layers which is positioned on the side of a negative electrode in regard to the vacuum chamber, so that the emission of electrons is avoided from the corresponding metallized layer to prevent a creeping discharge from being induced on the inner surface of the cylindrical insulator.

3 Claims, 3 Drawing Sheets

ELECTRON TUBE SEALING STRUCTURE

FIELD OF THE INVENTION

The invention relates to an electron tube sealing structure in which a vacuum chamber is sealed with an insulator having metallized layers at sealing portions.

BACKGROUND OF THE INVENTION

An electron tube comprises a vacuum chamber through which an electron beam is propagated from an electron gun to a collector. Such a vacuum chamber is sealed with a sealing structure which comprises a cylindrical insulator of ceramic material having metallized layers formed on sealing portions at both ends thereof, and sealing plates having a coefficient of thermal expansion approximately equal to that of the insulator, wherein the sealing plates are soldered to the metallized layers by use of, for instance, gold solder.

In the conventional sealing structure, however, there is a disadvantage that a creeping discharge occurs on the inner surface of the insulator when a predetermined voltage is applied across the insulator. Electrons are emitted from the metallized layer which is positioned on the side of a negative electrode. The electrons thus emitted collide with the inner surface of the insulator, producing a secondary emission which triggers further emission of electrons flowing from the negative electrode to a corresponding positive electrode.

To avoid such a creeping discharge in the inner surface of the cylindrical insulator, the length thereof is increased to decrease the gradient of a potential applied thereto. Furthermore, either the inner surface of the cylindrical insulator or a metallized layer exposed to the inner surface thereof is polished after the cylindrical insulator is assembled.

SUMMARY OF THE INVENTION

Accordingly, it is an object of the invention to provide an electron tube sealing structure in which a creeping discharge is prevented occurring in the inner surface of a cylindrical insulator.

It is a further object of the invention to provide an electron tube sealing structure in which the length of a cylindrical insulator is not large.

It is a still further object of the invention to provide an electron tube sealing structure in which it is not necessary to polish the inner surface of a cylindrical insulator after the assembly thereof.

It is a further object of the invention to provide an electron tube sealing structure in which any of metallized layers is prevented from exposure to the inner surface of a cylindrical insulator.

According to the invention, an electron tube sealing structure comprises a cylindrical insulator having metallized layers on both end surfaces thereof, sealing metal members soldered to the metallized layers of the cylindrical insulator, and electrodes connected to the sealing metal members. In the electron tube sealing structure, the cylindrical insulator is provided with at least one salient portion which is parallel to a direction of an electric field produced by a voltage applied across the sealing metal members and shields the sealing metal members positioned on the side of a negative electrode among the electrodes.

BRIEF DESCRIPTION OF DRAWINGS

The invention will be explained in more detail in conjunction with appended drawings wherein.

DESCRIPTION OF PREFERRED EMBODIMENTS

Figure 1:
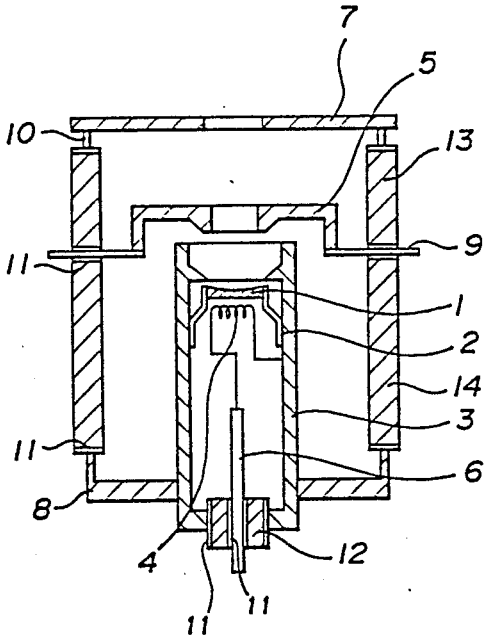
FIG. 1 PRIOR ART
FIG. 1 is a cross sectional view showing a conventional electron tube sealing structure applied to an electron gun portion of a linear beam microwave tube.

Before describing an electron tube sealing structure according to the invention, a conventional electron tube sealing structure applied to an electron gun portion of a linear beam microwave tube will be explained with reference to FIG. 1. In addition to the electron gun portion, the linear beam microwave tube includes a high frequency circuit portion in which microwaves and an electron beam interact and a collector portion in which the electron beam that has passed through the high frequency circuit portion is collected. In FIG. 1, a cathode plate 1 from which electrons are emitted is supported on the inner surface of a Wehnelt electrode 3 by means of a support member 2 of a heat-resisting metal such as tantalum, molybdenum etc. The cathode plate 1 is heated by a heater 4 which is introduced through a heater introducing rod 6 into the Wehnelt electrode 3, to which a terminal of the heater 4 is connected. When a predetermined voltage is applied to an anode 5, electrons are emitted from the cathode plate 1 to produce electron beam which is then introduced into a high frequency circuit portion (not shown) positioned at a stage next to a support plate 7. The anode 5 and the Wehnelt electrode 3 are surrounded by cylindrical insulators 13 and 14 of ceramic material such as alumina which are metallized at both ends to have metallized layers 11, respectively. The metallized layers 11 provide a sealing structure for a vacuum chamber, such that connection conductor members 8, 9 and 10 are soldered to the metallized layers 11 in which cathode and anode voltages are applied to the connection conductor members 8 and 9, respectively. Another insulator 12 of ceramic material which is metallized on inner and outer surfaces 11 is provided between the Wehnelt electrode 3 and the heater introducing rod 6.

In the sealing structure described above, however, high voltages are applied across the metallized layers 11 of the insulators 13 and 14, so that electrons are emitted from the metallized layers 11 positioned on the side of a negative electrode, resulting in a corona discharge which develops into a creeping discharge on the inner surfaces of the insulators 13 and 14 as described before. As a result, degradation of the withstand voltage characteristic is induced between the electrodes corresponding to positive and negative electrodes.

Figure 2:
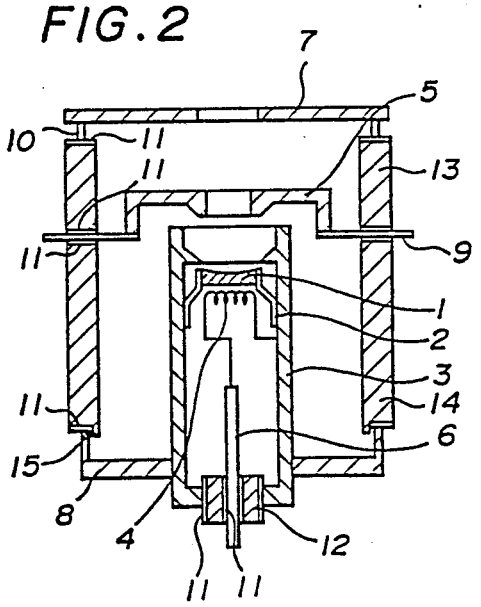
FIGS. 2 and 3 are cross sectional views showing electron tube sealing structures applied to the electron gun portions in first and second embodiments according to the invention.

Next, an electron tube sealing structure applied to an electron gun portion of a linear beam microwave tube in the first embodiment according to the invention will be explained with reference to FIG. 2. In the electron tube sealing structure, a cathode plate 1 from which electrons are emitted is supported on the inner surface of a Wehnelt electrode 3 by means of a support member 2 of a heat-resisting metal such as tantalum, molybdenum etc. The cathode plate 1 is heated by a heater 4, one end of which is connected to a heater introducing rod 6, and the other end of which is connected to the Wehnelt electrode 3. Furthermore, an anode 5 and a support plate 7 are provided in tandem with the Wehnelt electrode 3 wherein the Wehnelt electrode 3, the anode 5 and the support plate 7 are connected to connection conductor members 8, 9 and 10, respectively. The heater introducing rod 6 is insulated from the Wehnelt electrode 3 by interposing an insulator 12 of ceramic material therebetween, inner and outer surfaces of which are metallized to produce metallized layers 11. In order to provide a vacuum chamber, cylindrical insulators 13 and 14 are provided to surround the Wehnelt electrode 3 and the anode 5, both ends of which are metallized to produce metallized layers 11. The aforementioned connection conductor members 8, 9 and 10 are soldered to the metallized layers 11 of the cylindrical insulators 13 and 14 correspondingly. The cylindrical insulator 14 is provided with a salient portion 15 on the lowest inner surface thereof as shown in FIG. 2.

In operation, the cathode plate 1 is heated by the heater 4, while a voltage of several KV to one hundred several tens KV is applied to the anode 5, and potentials of the Wehnelt electrode 3 and the support plate 7 are controlled to be predetermined levels, so that electrons are emitted from the cathode plate 1 and introduced into a high frequency circuit portion (not shown) positioned next to the support plate 7 in which microwaves and an electron beam thus emitted interact. In this situation, no electrons are emitted and flow along the inner surface of the cylindrical insulator 13 from the metallized layer 11 thereof due to the existence of the salient portion 15, so that the aforementioned disadvantage can be avoided.

Figure 3:
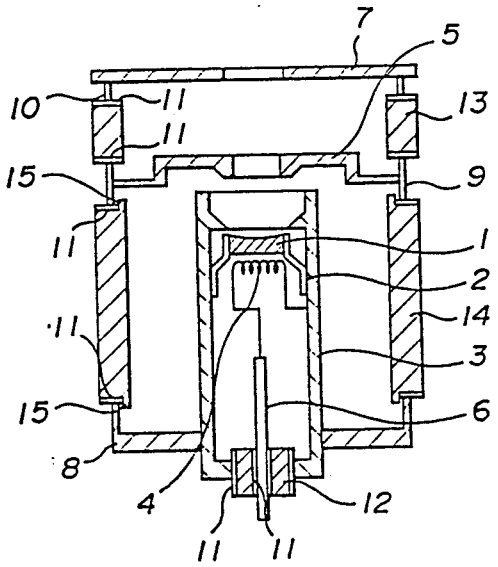

FIG. 3 shows an electron tube sealing structure applied to an electron gun portion of a linear beam microwave tube in the second embodiment according to the invention. As understood from the illustration therein, salient portions 15 are provided at both ends of the cylindrical insulator 14, that is, on both positive and negative electrode sides.

In the second embodiment, the metallized layers 11 are protected from being damaged by electrons emitted from the Wehnelt electrode 3, so that the soldered portions are maintained in a stabilized condition.

Figure 4:
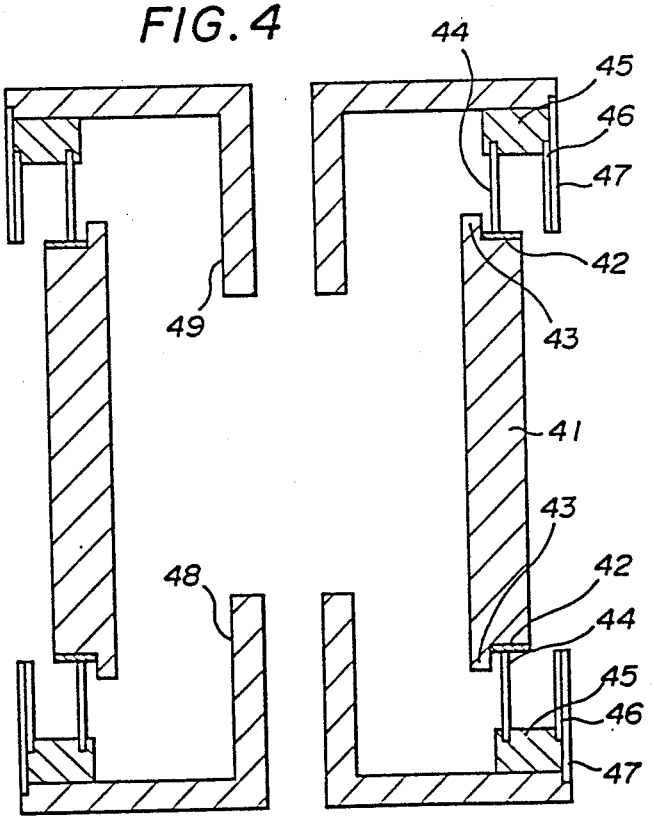
FIGS. 4 and 5 are cross sectional views showing electron tube sealing structures applied to a wide use including a Klystron oscillator in third and fourth embodiments according to the invention.

FIG. 4 shows an electron tube sealing structure applied to a wide use including a Klystron oscillator in the third embodiment according to the invention. In the electron tube sealing structure, an insulator 41 of ceramic material is metallized to have metallized layers 42 on both end surfaces, and configured with salient portions 43 extending parallel to the direction of electric field, so that the metallized layers 42 are hidden by the salient portions 43. First sealing plates 44 of such as kovar, which has a coefficient of thermal expansion approximately equal to that of ceramic material, are soldered to the metallized layers 42 and sealing mounts 45, together with second sealing plates 46, by use of, for instance, gold solder, thereby providing the so-called insulator assembly (otherwise called "ceramic assembly"). The insulator assembly is then assembled with first and second electrodes 48 and 49 each having a third sealing plate 47 by arc welding between the second and third sealing plates 46 and 47. The second and third sealing plates 46 and 47 may be soldered to magnetic pole pieces (not shown) provided at the outer periphery of the first and second electrodes 48 and 49. In comparison with the first and second embodiments, the first electrode 48 corresponds to the Wehnelt electrode 3, and the second electrode 49 corresponds to the anode 5.

Figure 5:
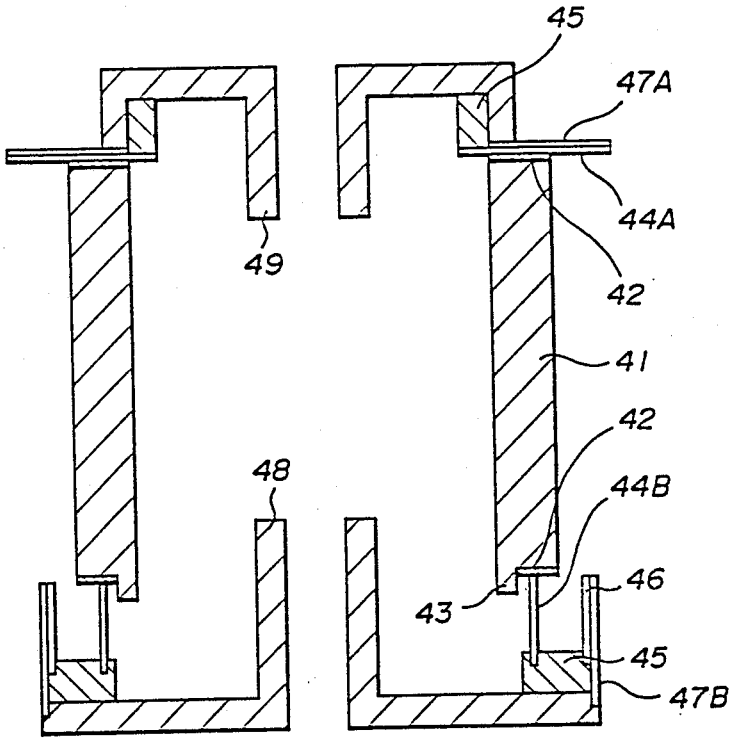

FIG. 5 shows an electron tube sealing structure applied to a wide use including a Klystron oscillator in the fourth embodiment according to the invention. In the electron tube sealing structure, the salient portion 43 is not provided on the positive electrode side of the cylindrical insulator 41, but is provided only on the side of a negative electrode, in a case where the sides of positive and negative electrodes are definitely determined. In the fourth embodiment, like parts are indicated by like reference numerals except that first sealing plates are indicated by 44A and 44B, and third sealing plates by 47A and 47B. As apparent from the illustration in FIG. 5, the first sealing plate 44*a* need not have a high dimensional precision as compared to the first sealing plate 44B.

Although the invention has been described with respect to specific embodiments for complete and clear disclosure, the appended claims are not thus limited but are to be construed as embodying all modifications and alternative constructions that may occur to one skilled in the art which fairly fall with the basic teaching herein set forth.

What is claimed is:

1. An electron tube sealing structure comprising:

a cylindrical insulator having metallized layers on both end surfaces thereof, sealing metal members, each being fixed to a corresponding one of said metallized layers to provide a vacuum chamber within the insulator, and electrodes each connected to a corresponding one of said sealing members for producing an electric field across said sealing members, wherein said cylindrical insulator is provided with at least one salient portion at an inner end thereof, said salient portion being parallel to the electric field and positioned on the side of a negative electrode for said electric field, thereby shielding at least a corresponding one of said metallized layers.

2. An electron tube sealing structure according to claim 1, wherein said cylindrical insulator is provided with a pair of said salient portions at both inner ends thereof.

3. An electron tube sealing structure according to claim 1, wherein said electrodes are a Wehnelt electrode for a cathode, and an anode, said Wehnelt electrode containing a heater and a cathode plate therein.

* * * * *